US007984567B2

(12) United States Patent
Bertakis

(10) Patent No.: US 7,984,567 B2
(45) Date of Patent: Jul. 26, 2011

(54) APPARATUS FOR CLEANING SIMULATED HAIR ARTICLES

(76) Inventor: Christ Bill Bertakis, Grosse Pointe Woods, MI (US)

( * ) Notice: Subject to any disclaimer, the term of this patent is extended or adjusted under 35 U.S.C. 154(b) by 0 days.

(21) Appl. No.: 12/246,642

(22) Filed: Oct. 7, 2008

(65) Prior Publication Data

US 2010/0083520 A1 Apr. 8, 2010

(51) Int. Cl.
*F26B 21/06* (2006.01)

(52) U.S. Cl. ..... 34/97; 34/98; 34/100; 34/104; 34/105; 34/210; 34/218; 132/329; 392/384; 601/15; 705/1; 705/14; 55/345; 55/337; 95/217

(58) Field of Classification Search ..... 34/97, 98, 34/100, 104, 105, 210, 218; 55/345, 337; 392/384; 132/329; 705/1, 14; 95/217; 601/15
See application file for complete search history.

(56) References Cited

U.S. PATENT DOCUMENTS

| | | | | | |
|---|---|---|---|---|---|
| 1,574,617 | A | * | 2/1926 | Gallagher | 428/6 |
| 1,574,618 | A | * | 2/1926 | Gallagher | 19/66 R |
| 2,097,952 | A | * | 11/1937 | Lohr | 601/15 |
| 2,099,744 | A | * | 11/1937 | Lohr | 601/17 |
| 2,235,296 | A | * | 3/1941 | Muncheryan | 250/455.11 |
| 2,236,397 | A | * | 3/1941 | Drummond | 34/350 |
| 2,295,824 | A | * | 9/1942 | Batsel | 34/99 |
| 2,560,808 | A | * | 7/1951 | MacCallum | 34/562 |
| 2,619,735 | A | * | 12/1952 | Jacobowitz | 34/68 |
| 2,698,894 | A | * | 1/1955 | Stein | 392/380 |
| 2,719,365 | A | * | 10/1955 | Mangilo et al. | 34/195 |
| 3,004,540 | A | * | 10/1961 | Ronzi | 132/212 |
| 3,058,233 | A | * | 10/1962 | Guhl | 34/99 |
| 3,086,534 | A | * | 4/1963 | Dalk et al. | 132/208 |
| 3,226,179 | A | * | 12/1965 | Manasian et al. | 8/127.6 |
| 3,391,986 | A | * | 7/1968 | Thorsen | 8/128.1 |
| 3,426,444 | A | * | 2/1969 | Schmersahl et al. | 34/218 |
| 3,508,338 | A | * | 4/1970 | Guhl | 34/283 |
| 3,577,650 | A | * | 5/1971 | Brahm | 34/622 |
| 4,074,369 | A | * | 2/1978 | Harmon | 4/518 |
| 4,164,951 | A | * | 8/1979 | Shaler et al. | 132/233 |
| 4,506,454 | A | * | 3/1985 | Kerschgens | 34/275 |
| 4,553,339 | A | * | 11/1985 | Rigo | 34/99 |
| 4,578,185 | A | * | 3/1986 | Wilson et al. | 210/85 |
| 4,869,872 | A | * | 9/1989 | Baltes | 422/1 |
| 5,095,639 | A | * | 3/1992 | Slavin, Jr. | 34/282 |
| 5,143,750 | A | * | 9/1992 | Yamagata et al. | 427/601 |
| 5,150,705 | A | * | 9/1992 | Stinson | 607/94 |
| 5,234,718 | A | * | 8/1993 | Mino et al. | 427/352 |
| 5,249,234 | A | * | 9/1993 | Butler | 381/322 |
| 5,275,155 | A | * | 1/1994 | Changaris | 607/94 |
| 5,300,097 | A | * | 4/1994 | Lerner et al. | 607/93 |
| 5,322,473 | A | * | 6/1994 | Hofstra et al. | 454/186 |
| 5,325,600 | A | * | 7/1994 | Gentile | 34/260 |
| 5,424,515 | A | * | 6/1995 | Gentile | 219/702 |

(Continued)

FOREIGN PATENT DOCUMENTS

DE 4406922 C1 * 9/1995

(Continued)

*Primary Examiner* — Stephen M. Gravini
(74) *Attorney, Agent, or Firm* — Reising Ethington P.C.

(57) ABSTRACT

An apparatus for cleaning a simulated hair article such as a wig or other hairpiece. In one exemplary embodiment, the apparatus includes a housing, an ozone generator, an ultraviolet light source, and a gas recirculation structure. The apparatus reduces or eliminates microorganisms such as bacteria, viruses, molds, and fungi from the simulated hair article, and also eliminates odors therefrom.

4 Claims, 1 Drawing Sheet

U.S. PATENT DOCUMENTS

| | | | | |
|---|---|---|---|---|
| 5,475,933 | A * | 12/1995 | Ueda | 34/90 |
| 5,487,877 | A * | 1/1996 | Choi | 422/300 |
| 5,497,944 | A * | 3/1996 | Weston et al. | 239/321 |
| 5,524,358 | A * | 6/1996 | Matz | 34/275 |
| 5,547,635 | A * | 8/1996 | Duthie, Jr. | 422/24 |
| 5,592,750 | A * | 1/1997 | Eichten | 34/104 |
| 5,662,271 | A * | 9/1997 | Weston et al. | 239/321 |
| 5,688,475 | A * | 11/1997 | Duthie, Jr. | 422/186.3 |
| 5,873,179 | A * | 2/1999 | Gregory et al. | 34/90 |
| 6,053,180 | A | 4/2000 | Kwan | |
| 6,108,934 | A * | 8/2000 | Todorovic | 34/283 |
| 6,184,193 | B1 * | 2/2001 | Yamada | 510/291 |
| 6,193,785 | B1 * | 2/2001 | Huf | 95/54 |
| 6,238,516 | B1 * | 5/2001 | Watson et al. | 162/8 |
| 6,285,828 | B1 * | 9/2001 | Cafaro | 392/385 |
| 6,363,215 | B1 * | 3/2002 | Cafaro | 392/384 |
| 6,374,511 | B1 * | 4/2002 | Iwata | 34/248 |
| 6,393,718 | B1 * | 5/2002 | Harris et al. | 34/96 |
| 6,423,942 | B1 * | 7/2002 | Liao | 219/222 |
| 6,464,754 | B1 * | 10/2002 | Ford | 95/26 |
| 6,484,654 | B2 * | 11/2002 | Chiu | 111/200 |
| 6,516,536 | B2 * | 2/2003 | Ryden | 34/106 |
| 6,553,713 | B2 * | 4/2003 | Chiu | 47/17 |
| 6,564,591 | B2 * | 5/2003 | Noyes et al. | 68/5 C |
| 6,574,979 | B2 * | 6/2003 | Faqih | 62/285 |
| 6,687,339 | B2 * | 2/2004 | Martin | 379/88.14 |
| 6,691,536 | B2 * | 2/2004 | Severns et al. | 68/12.27 |
| 6,718,650 | B2 * | 4/2004 | Ross | 34/90 |
| 6,726,386 | B1 * | 4/2004 | Gruenbacher et al. | 401/7 |
| 6,746,114 | B2 * | 6/2004 | Takahashi et al. | 347/100 |
| 6,750,191 | B2 * | 6/2004 | Kasturi et al. | 510/417 |
| 6,763,606 | B2 * | 7/2004 | Saida | 34/97 |
| 6,793,685 | B2 * | 9/2004 | Noyes et al. | 8/149.2 |
| 6,868,690 | B2 * | 3/2005 | Faqih | 62/291 |
| 6,878,146 | B2 * | 4/2005 | Ringler et al. | 606/27 |
| 6,898,951 | B2 * | 5/2005 | Severns et al. | 68/5 C |
| 6,928,235 | B2 * | 8/2005 | Pollack | 392/380 |
| 6,929,702 | B1 * | 8/2005 | Motsenbocker | 134/6 |
| 6,955,708 | B1 * | 10/2005 | Julos et al. | 95/59 |
| 6,977,722 | B2 * | 12/2005 | Wohlstadter et al. | 356/246 |
| 7,021,848 | B1 * | 4/2006 | Gruenbacher et al. | 401/1 |
| 7,047,660 | B2 * | 5/2006 | Leventhal | 34/97 |
| 7,108,440 | B1 * | 9/2006 | Gruenbacher et al. | 401/132 |
| 7,159,333 | B2 * | 1/2007 | Lewis et al. | 34/329 |
| 7,160,949 | B2 * | 1/2007 | Ota et al. | 525/242 |
| 7,194,316 | B2 * | 3/2007 | Bousfield et al. | 607/150 |
| 7,201,764 | B2 * | 4/2007 | Pearl et al. | 607/88 |
| 7,255,506 | B2 * | 8/2007 | Gruenbacher et al. | 401/7 |
| 7,258,695 | B2 * | 8/2007 | Carullo et al. | 607/88 |
| 7,264,649 | B1 * | 9/2007 | Johnson et al. | 95/10 |
| 7,275,400 | B2 * | 10/2007 | Severns et al. | 68/18 F |
| 7,306,620 | B2 * | 12/2007 | Cumbie | 607/88 |
| 7,344,832 | B2 * | 3/2008 | Henderson et al. | 435/6 |
| 7,350,317 | B2 * | 4/2008 | Matsui et al. | 34/96 |
| 7,374,655 | B2 * | 5/2008 | Roberts et al. | 205/701 |
| 7,434,586 | B2 * | 10/2008 | Higashi et al. | 131/352 |
| 7,481,891 | B2 * | 1/2009 | Higashi et al. | 131/274 |
| D585,997 | S * | 2/2009 | Adam et al. | D24/210 |
| 7,488,409 | B1 * | 2/2009 | Carson et al. | 205/701 |
| 7,494,502 | B2 * | 2/2009 | Cumbie | 607/88 |
| 7,517,445 | B2 * | 4/2009 | Carson et al. | 205/688 |
| 7,604,780 | B2 * | 10/2009 | Teran et al. | 422/186.07 |
| 7,658,891 | B1 * | 2/2010 | Barnes | 422/186.03 |
| 7,665,227 | B2 * | 2/2010 | Wright et al. | 34/339 |
| 7,676,952 | B2 * | 3/2010 | Nakagawa et al. | 34/97 |
| 7,722,709 | B2 * | 5/2010 | Conrad | 96/416 |
| 7,735,345 | B2 * | 6/2010 | Wright et al. | 68/13 R |
| 7,740,675 | B2 * | 6/2010 | Conrad | 55/345 |
| 7,745,990 | B2 * | 6/2010 | Kondo et al. | 313/504 |
| 7,749,293 | B2 * | 7/2010 | Conrad | 55/345 |
| 7,776,120 | B2 * | 8/2010 | Conrad | 55/426 |
| 7,781,062 | B2 * | 8/2010 | Kitaike et al. | 428/407 |
| 7,803,207 | B2 * | 9/2010 | Conrad | 55/426 |
| 7,811,345 | B2 * | 10/2010 | Conrad | 55/343 |
| 7,842,246 | B2 * | 11/2010 | Wohlstadter et al. | 422/401 |
| 7,846,295 | B1 * | 12/2010 | Medoff | 162/50 |
| 7,867,358 | B2 * | 1/2011 | Medoff | 162/50 |
| 7,875,173 | B1 * | 1/2011 | Barnes | 210/167.1 |
| 7,887,612 | B2 * | 2/2011 | Conrad | 55/343 |
| 2001/0033639 | A1 * | 10/2001 | Martin | 379/88.14 |
| 2001/0049883 | A1 * | 12/2001 | Ryden | 34/104 |
| 2002/0000237 | A1 * | 1/2002 | Laughlin | 132/200 |
| 2002/0006275 | A1 * | 1/2002 | Pollack | 392/380 |
| 2002/0011075 | A1 * | 1/2002 | Faqih | 62/285 |
| 2002/0017310 | A1 * | 2/2002 | Gruenbacher et al. | 132/320 |
| 2002/0020027 | A1 * | 2/2002 | Noyes et al. | 8/149.2 |
| 2002/0038519 | A1 * | 4/2002 | Iwata | 34/248 |
| 2002/0125309 | A1 * | 9/2002 | Chiu | 235/379 |
| 2002/0129547 | A1 * | 9/2002 | Chiu | 47/65.5 |
| 2002/0133886 | A1 * | 9/2002 | Severns et al. | 8/142 |
| 2002/0157583 | A1 * | 10/2002 | Chiu | 111/100 |
| 2002/0159215 | A1 * | 10/2002 | Siess | 361/232 |
| 2003/0007051 | A1 * | 1/2003 | Takahashi et al. | 347/100 |
| 2003/0033726 | A1 * | 2/2003 | Saida | 34/96 |
| 2003/0034459 | A1 * | 2/2003 | Bonin | 250/491.1 |
| 2003/0055179 | A1 * | 3/2003 | Ota et al. | 525/242 |
| 2003/0152373 | A1 * | 8/2003 | Wong et al. | 392/385 |
| 2003/0159457 | A1 * | 8/2003 | Faqih | 62/285 |
| 2003/0167576 | A1 * | 9/2003 | Noyes et al. | 8/149.2 |
| 2003/0192562 | A1 * | 10/2003 | Higashi et al. | 131/365 |
| 2004/0022677 | A1 * | 2/2004 | Wohlstadter et al. | 422/52 |
| 2004/0053798 | A1 * | 3/2004 | Kasturi et al. | 510/130 |
| 2004/0071615 | A1 * | 4/2004 | Khatchatrian et al. | 422/186.12 |
| 2004/0129032 | A1 * | 7/2004 | Severns et al. | 68/5 C |
| 2004/0159001 | A1 * | 8/2004 | Ross | 34/90 |
| 2004/0221858 | A1 * | 11/2004 | Higashi et al. | 131/274 |
| 2004/0231371 | A1 * | 11/2004 | Scheper et al. | 68/3 R |
| 2004/0232007 | A1 * | 11/2004 | Carson et al. | 205/688 |
| 2005/0050644 | A1 * | 3/2005 | Severns et al. | 8/115.51 |
| 2005/0052646 | A1 * | 3/2005 | Wohlstadter et al. | 356/311 |
| 2005/0108889 | A1 * | 5/2005 | Leventhal | 34/96 |
| 2005/0142033 | A1 * | 6/2005 | Glezer et al. | 422/58 |
| 2005/0183964 | A1 * | 8/2005 | Roberts et al. | 205/701 |
| 2006/0035234 | A1 * | 2/2006 | Henderson et al. | 435/6 |
| 2006/0064892 | A1 * | 3/2006 | Matsui et al. | 34/96 |
| 2006/0081073 | A1 * | 4/2006 | Vandrish et al. | 73/864.33 |
| 2006/0110617 | A1 * | 5/2006 | Kitaike et al. | 428/522 |
| 2006/0201016 | A1 * | 9/2006 | Nakagawa et al. | 34/96 |
| 2007/0059454 | A1 * | 3/2007 | Slimak | 427/421.1 |
| 2007/0086913 | A1 * | 4/2007 | Teran et al. | 422/28 |
| 2007/0151041 | A1 * | 7/2007 | McAllister et al. | 8/149.2 |
| 2007/0151129 | A1 * | 7/2007 | McAllister et al. | 38/3 |
| 2007/0151310 | A1 * | 7/2007 | Wright et al. | 68/3 R |
| 2007/0151311 | A1 * | 7/2007 | McAllister et al. | 68/3 R |
| 2007/0151312 | A1 * | 7/2007 | Bruce et al. | 68/3 R |
| 2007/0163093 | A1 * | 7/2007 | Wright et al. | 28/100 |
| 2007/0163094 | A1 * | 7/2007 | Wright et al. | 28/100 |
| 2007/0163095 | A1 * | 7/2007 | McAllister et al. | 28/100 |
| 2007/0163096 | A1 * | 7/2007 | McAllister et al. | 28/100 |
| 2007/0163097 | A1 * | 7/2007 | Metcalfe et al. | 28/100 |
| 2007/0163098 | A1 * | 7/2007 | Tomasi et al. | 28/100 |
| 2007/0209334 | A1 * | 9/2007 | Conrad | 55/337 |
| 2007/0209335 | A1 * | 9/2007 | Conrad | 55/337 |
| 2007/0209336 | A1 * | 9/2007 | Conrad | 55/337 |
| 2007/0209337 | A1 * | 9/2007 | Conrad | 55/337 |
| 2007/0209338 | A1 * | 9/2007 | Conrad | 55/345 |
| 2007/0209339 | A1 * | 9/2007 | Conrad | 55/345 |
| 2007/0209340 | A1 * | 9/2007 | Conrad | 55/345 |
| 2007/0209519 | A1 * | 9/2007 | Conrad | 96/414 |
| 2007/0219333 | A1 * | 9/2007 | Shimono et al. | 526/249 |
| 2007/0223988 | A1 * | 9/2007 | Gruenbacher et al. | 401/137 |
| 2007/0234469 | A1 * | 10/2007 | Denkewicz et al. | 4/213 |
| 2008/0053379 | A1 * | 3/2008 | Markewitz | 119/600 |
| 2008/0070303 | A1 * | 3/2008 | West et al. | 435/377 |
| 2008/0134538 | A1 * | 6/2008 | McFarland | 34/209 |
| 2008/0168677 | A1 * | 7/2008 | Miller | 34/202 |
| 2008/0172900 | A1 * | 7/2008 | Ceva | 34/96 |
| 2008/0172901 | A1 * | 7/2008 | Parziale | 34/97 |
| 2008/0201979 | A1 * | 8/2008 | Rhoades | 34/283 |
| 2008/0238305 | A1 * | 10/2008 | Kondo et al. | 313/504 |
| 2008/0256825 | A1 * | 10/2008 | Hsu | 34/529 |
| 2008/0282571 | A1 * | 11/2008 | Ueda et al. | 34/90 |
| 2008/0282572 | A1 * | 11/2008 | Ueda et al. | 34/218 |
| 2008/0282576 | A1 * | 11/2008 | Ueda et al. | 34/562 |
| 2008/0286145 | A1 * | 11/2008 | Ratcliffe | 422/24 |
| 2009/0009923 | A1 * | 1/2009 | Tocco | 361/231 |
| 2009/0010801 | A1 * | 1/2009 | Murphy et al. | 422/4 |

2009/0038551 A1* 2/2009 Baker et al. ..... 119/14.02
2009/0038552 A1* 2/2009 Baker et al. ..... 119/14.03
2009/0048555 A1* 2/2009 Stryker et al. ..... 604/20
2009/0078326 A1* 3/2009 Rosario et al. ..... 137/827
2009/0105605 A1* 4/2009 Abreu ..... 600/549
2009/0148342 A1* 6/2009 Bromberg et al. ..... 422/37
2009/0176312 A1* 7/2009 Selinfreund ..... 436/164
2009/0178295 A1* 7/2009 He et al. ..... 34/380
2009/0286295 A1* 11/2009 Medoff et al. ..... 435/162
2009/0312537 A1* 12/2009 Medoff ..... 536/63
2009/0321026 A1* 12/2009 Medoff ..... 162/50
2010/0018262 A1* 1/2010 Beihoff et al. ..... 68/5 C
2010/0083520 A1* 4/2010 Bertakis ..... 34/60
2010/0087687 A1* 4/2010 Medoff ..... 568/840
2010/0108567 A1* 5/2010 Medoff ..... 208/49
2010/0112242 A1* 5/2010 Medoff ..... 428/22
2010/0123095 A1* 5/2010 Minor et al. ..... 252/68
2010/0124583 A1* 5/2010 Medoff ..... 426/2
2010/0127246 A1* 5/2010 Nakayama et al. ..... 257/40
2010/0179315 A1* 7/2010 Medoff ..... 536/123.13
2010/0184033 A1* 7/2010 West et al. ..... 435/6
2010/0186176 A1* 7/2010 Wright et al. ..... 8/137
2010/0206501 A1* 8/2010 Medoff ..... 162/50
2010/0210745 A1* 8/2010 Mcdaniel et al. ..... 521/55
2010/0223752 A1* 9/2010 Conrad ..... 15/347
2010/0233146 A1* 9/2010 McDaniel ..... 424/94.2
2010/0242222 A1* 9/2010 Conrad ..... 15/347
2010/0273019 A1* 10/2010 Kitaike et al. ..... 428/520
2010/0304439 A1* 12/2010 Medoff ..... 435/72
2010/0304440 A1* 12/2010 Medoff ..... 435/72
2010/0313531 A1* 12/2010 Conrad ..... 55/426
2011/0016928 A1* 1/2011 Beihoff et al. ..... 68/19
2011/0027837 A1* 2/2011 Medoff ..... 435/99
2011/0039317 A1* 2/2011 Medoff ..... 435/155

FOREIGN PATENT DOCUMENTS

| | | | | |
|---|---|---|---|---|
| EP | 1616499 | A2 | * | 1/2006 |
| GB | 331845 | | | 7/1930 |
| GB | 2236397 | A | * | 4/1991 |
| JP | 58185512 | A | * | 10/1983 |
| JP | 62269975 | A | * | 11/1987 |
| JP | 63166494 | A | * | 7/1988 |
| JP | 63201113 | A | * | 8/1988 |
| JP | 01213216 | A | * | 8/1989 |
| JP | 03012290 | A | * | 1/1991 |
| JP | 03019961 | A | * | 1/1991 |
| JP | 03151094 | A | * | 6/1991 |
| JP | 05050077 | A | * | 3/1993 |
| JP | 05123351 | A | * | 5/1993 |
| JP | 05220185 | A | * | 8/1993 |
| JP | 05220186 | A | * | 8/1993 |
| JP | 05220187 | A | * | 8/1993 |
| JP | 06205816 | A | * | 7/1994 |
| JP | 2004332142 | A | * | 11/2004 |
| JP | 2007016360 | A | * | 1/2007 |
| WO | WO 9832414 | A2 | * | 7/1998 |
| WO | WO 02056803 | A1 | * | 7/2002 |
| WO | WO 2004019722 | A2 | * | 3/2004 |
| WO | WO 2010119063 | A2 | * | 10/2010 |

* cited by examiner

APPARATUS FOR CLEANING SIMULATED HAIR ARTICLES

FIELD OF THE INVENTION

The present invention generally relates to equipment used to clean simulated hair articles.

BACKGROUND OF THE INVENTION

Many people wear simulated hair articles such as wigs, toupees, hair extensions, moustaches, and beards to modify their appearance. The simulated hair articles may require periodic cleaning to maintain a good appearance, eliminate odors, and reduce or eliminate growth of microorganisms such as bacteria, viruses, molds, fungi, and the like.

SUMMARY OF THE INVENTION

One implementation of a presently preferred apparatus for cleaning a simulated hair article includes a housing, an ozone generator, and an ultraviolet light source. The housing has a chamber that encloses the simulated hair article while being cleaned. The ozone generator communicates with the chamber to provide ozone gas inside the chamber to help clean the simulated hair article. And the ultraviolet light source is supported by the housing and emits ultraviolet light inside the chamber to help clean the simulated hair article.

Another implementation of a presently preferred apparatus for cleaning a simulated hair article includes a housing, an ozone generator, and a gas recirculation structure. The housing has a chamber that encloses the simulated hair article, and has a compartment that is separate from the chamber. The ozone generator is located in the compartment and provides ozone gas inside the chamber to clean the simulated hair article. And the gas recirculation structure allows gas to go from the chamber, to the ozone generator, and back to the chamber.

BRIEF DESCRIPTION OF THE DRAWINGS

The following detailed description of preferred embodiments and best mode will be set forth with reference to the accompanying drawings, in which.

DETAILED DESCRIPTION OF THE PREFERRED EMBODIMENTS

Figure 2:
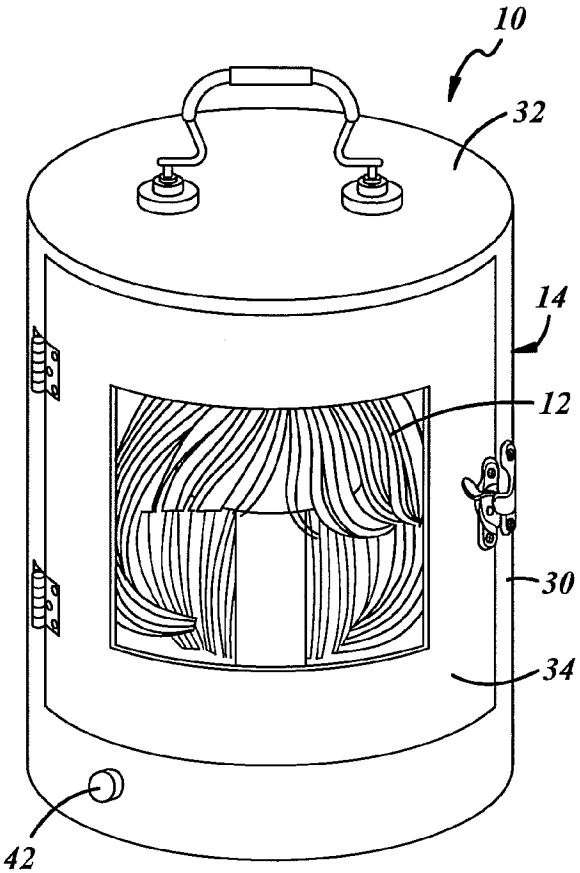
FIG. 2 is a front perspective view of the cleaning apparatus of FIG. 1, with the door closed and a simulated hair article disposed therein.
Figure 1:
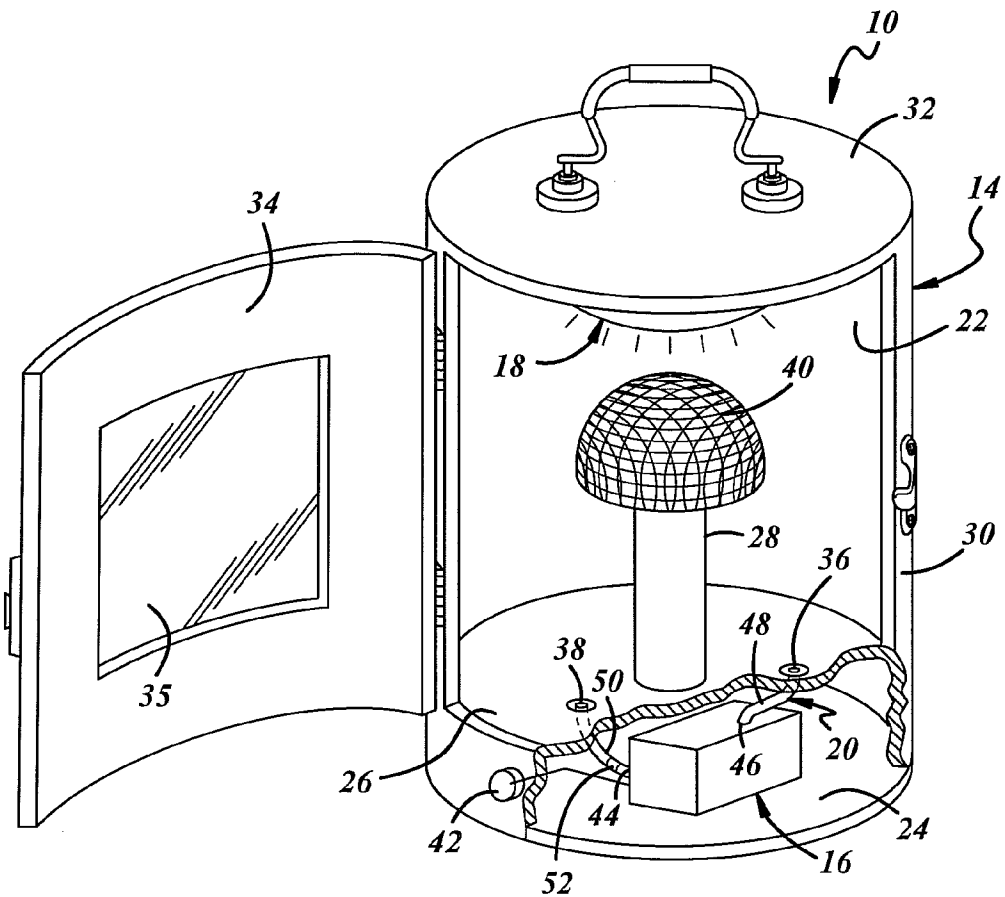
FIG. 1 is a front perspective view of an exemplary embodiment of a cleaning apparatus for simulated hair articles, with an open door and showing a portion of the cleaning apparatus cut-away.

Referring in more detail to the drawings, FIGS. 1 and 2 show an exemplary embodiment of a cleaning apparatus 10 that is used to clean simulated hair articles. The cleaning apparatus 10 sterilizes, disinfects, sanitizes, and deodorizes a simulated hair article 12, such as a wig, without the need of water, shampoo, soap, and other cleaning solutions, which commonly require substantial restyling of the simulated hair article after being washed therewith. It also reduces or eliminates odors and microorganisms such as bacteria, viruses, molds, fungi, and the like. The cleaning apparatus 10 is a piece of equipment that is portable and convenient for at-home use, and requires a reduced amount of time for effective cleaning, in some cases 5-10 minutes. As used herein, the term "simulated hair article" includes hair articles made with natural hair, synthetic hair, or a combination of both. In different embodiments, the cleaning apparatus 10 includes a housing 14, an ozone generator 16, an ultraviolet (UV) light source 18, and a gas recirculation structure 20.

The housing 14 encloses and seals the simulated hair article 12 while the simulated hair article is being cleaned. Referring to FIGS. 1 and 2, the housing 14 has a chamber 22, a compartment 24, a panel 26, and a pedestal 28 carried by the panel. The chamber 22 isolates the simulated hair article 12 from the environment outside of the housing 14. The chamber 22 is defined by a cylindrical wall 30, a ceiling or top 32, a door 34, and the panel 26. The door 34 is hinged at one side, preferably locks or latches at the other side when closed, and has a window 35 for viewing the simulated hair article when the door is closed. The door 34 can also have a seal (not shown) around its periphery for sealing the opening when the door is closed.

The compartment 24 houses the ozone generator 16 and the gas recirculation structure 20. The panel 26 extends across the housing 14 and separates the chamber 22 and the compartment 24. The panel 26 has a first opening 36 for connection with the gas recirculation structure 20, and has a second opening 38 also for connection with the gas recirculation structure. The pedestal 28 is carried by the panel 26 and supports the simulated hair article 12. The pedestal 28 has a wire-frame 40 that permits gas to pass therethrough and to the simulated hair article 12 so that gas contacts the simulated hair article on all sides. The pedestal 28 is removable from the housing 14.

In other embodiments, the housing 14 can have different arrangements and configurations, and can have more, less, and/or different components than shown and described. To cite but a few examples, an air freshener could be provided in the housing 14 to emit a scent or odor neutralizer, the pedestal 28 need not be provided and another way of supporting the simulated hair article 12 could be used, the housing could have a rectangular shape, and the door 34 could be located in the ceiling 32.

The ozone generator 16 converts oxygen in the air into ozone gas ($O_3$) and supplies the ozone gas to the chamber 22, where the ozone gas undergoes an oxidation reaction that helps clean the simulated hair article 12. The ozone generator 16 can come in various types including, but not limited to, a corona discharge type, a cold plasma type, and an ultraviolet type. Taking the corona discharge type as an example, the ozone generator 16 produces about 300 mg of ozone gas per hour at about 3.5 cubic feet of gas per minute. In other embodiments, the ozone generator 16 can produce up to about 1000 mg of ozone gas per hour. Referring to FIG. 1, the ozone generator 16 includes an electric switch 42 that turns it ON/OFF, an inlet 44 for receiving gas, and an outlet 46 for discharging ozone gas. The switch 42 could optionally provide a timer that turns the ozone generator ON for a predetermined amount of time, such as 5-10 minutes, and then turns the ozone generator OFF. The ozone generator 16 is located within the compartment 24. Though not shown, a fan, blower, pump, and/or other means of forced circulation could be integrated in the ozone generator 16, or could be provided as a separate component; in these cases, the component draws gas into the ozone generator, expels gas out of the ozone generator, or both. In other embodiments, the inlet 44 could communicate with an exterior of the housing 14 through a conduit, and the ozone generator 16 could be located outside of the compartment 24 and mounted on the housing exterior, to name but a few examples.

The UV light source 18 emits ultraviolet light inside of the chamber 22 to help clean the simulated hair article 12. The emitted ultraviolet light includes light in the UVC range (280-100 nm), and includes wavelengths of about 185 nm, and/or 254-265 nm. Wavelengths of about 185 nm can convert atmospheric oxygen ($O_2$) into ozone gas. Referring to FIG. 1, the UV light source 18 is supported by the housing 14 and located on the ceiling 32 to direct ultraviolet light toward a top of the simulated hair article 12. The switch 42 also turns the UV light source 18 ON/OFF, though a separate switch can be provided exclusively for the UV light source. In other embodiments, the UV light source 18 could be positioned at other locations in the chamber 22 such as on the cylindrical wall 30 to direct ultraviolet light toward a side of the simulated hair article 12, and the UV light source need not be provided at all where the ozone generator 16 alone would clean and sanitize the simulated hair article, to name but a few examples.

The gas recirculation structure 20 circulates gas through the cleaning apparatus 10 from the chamber 22, into the ozone generator 16, and back to the chamber with ozone therewith. In some cases, the circulation increases the concentration of ozone gas in the chamber 22 by taking oxygen that may not have been initially converted or has reverted back to oxygen, and converting it into ozone gas. Still referring to FIG. 1, the gas recirculation structure 20 includes a first conduit 48 extending from the outlet 46 to the first opening 36, and includes a second conduit 50 extending from the second opening 38 to the inlet 44. The first conduit 48 carries gas with ozone therein exiting the ozone generator 16 to the chamber 22, and the second conduit 50 carries gas from the chamber 22 to enter the ozone generator. In other embodiments, the gas recirculation structure 20 can have different arrangements and configurations, and can have more, less, and/or different components than shown and described. For example, the second conduit 50 need not be provided and instead gas could simply flow through the second opening 38 and into the inlet 44, or simply flow through around the panel 26 whereby the panel is not sealed air-tight around its periphery. Indeed, the gas recirculation structure 20 need not be provided at all whereby the ozone generator 16 could draw-in gas from the housing exterior through one or more slots cut into the housing 14, for example. In this case, only the first conduit 48 would be provided and the inlet 44 would draw gas through the slots and into the ozone generator 16.

In some embodiments, a desiccant 52 is provided in the cleaning apparatus 10 to remove water and/or moisture from gas passing therethrough. The desiccant 52 can include various substances that absorb water and/or moisture such as silica gel and calcium chloride, for example. Referring to FIG. 1, the desiccant 52 is located at the inlet 44 of the ozone generator 16. The desiccant could also be located inside of the second conduit 50. Taking water and/or moisture out of the gas entering the ozone generator 16 increases the ozone conversion efficiency of the ozone generator.

In use, the cleaning apparatus 10 preferably uses a combination of ozone gas and ultraviolet light to clean the simulated hair article 12. The simulated hair article 12 is placed on the pedestal 28 and the door 34 is closed to isolate the chamber 22 from the outside environment. Once closed, gas trapped inside of the chamber 22 is subject to circulation through the gas recirculation structure 20. The switch 42 activates the ozone generator 16, the UV light source 18, or a combination of both. For example, in different cleaning cycles, the ozone generator 16 produces ozone gas for a set period of time, then the UV light source 18 emits ultraviolet light for another set period of time, or both occur simultaneously. Likewise, the gas recirculation structure 20 circulates gas through the cleaning apparatus 10 for a set period of time, which is less than the total time for the cleaning cycle, which is equal to the total time, or which is greater than the total time. In the latter case, the gas recirculation structure 20 circulates gas through the ozone generator 16 after the ozone generator ceases producing ozone gas. The ozone generator 16 is turned OFF for a sufficient period of time for ozone gas to revert back to oxygen.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. An apparatus for cleaning a simulated hair article, the apparatus comprising:

a housing having a pair of ends, a wall extending therebetween, a panel, and a door, the housing further comprising a chamber that encloses the simulated hair article while being cleaned and having a compartment separate from the chamber, wherein the compartment is separated from the chamber by the panel, the panel extending across the housing so that the chamber is defined at least in part by the wall of the housing, at least in part by face of the panel, and at least in part by one end of the housing, and the compartment is defined at least in part by the wall of the housing, at least in part by face of the panel, and at least in part by one end of the housing, and wherein the door is opened to provide access to the chamber for placing the simulated hair article therein and wherein the door is closed while the apparatus is operating; and an electrically powered ozone generator that converts atmospheric oxygen to ozone gas, the ozone generator being located in the compartment and providing ozone gas inside the chamber via a conduit extending from an outlet of the ozone generator to an opening in the panel to help sterilize, disinfect, sanitize, deodorize, or any combination thereof, the simulated hair article by oxidation reactions with microorganisms and other odor-producing substances on the simulated hair article, wherein the apparatus cleans the simulated hair article without the use of water, shampoo, soap, or other liquid cleaning solutions that could substantially alter the shape of the simulated hair article with respect to the shape of the simulated hair article when the simulated hair article is initially placed in the apparatus, wherein the ozone gas converted by the ozone generator is at ambient temperature throughout use of the apparatus and is not otherwise heated above ambient temperature during use of the apparatus, and wherein the simulated hair article is cleaned by the ozone gas while the simulated hair article is in a dry state.

2. The apparatus of claim 1 further comprising an ultraviolet light source supported by the housing and emitting ultraviolet light inside the chamber and toward the simulated hair article to help sterilize, disinfect, sanitize, deodorize, or any combination thereof, the simulated hair article.

3. The apparatus of claim 1 further comprising a gas recirculation structure that permits gas to flow from the ozone generator, through the conduit extending from the outlet of the ozone generator to the opening in the panel, through the opening and into the chamber, and back through a second opening in the panel to the inlet of the ozone generator, wherein the gas flowing back through the second opening in the panel includes less ozone gas than the gas flowing through the first opening when the simulated hair article is being cleaned.

4. The apparatus of claim 1 further comprising a pedestal located inside the chamber to support the simulated hair article, the pedestal having a wire-frame to allow ozone gas to contact the simulated hair article on all sides of the simulated hair article.

* * * * *

UNITED STATES PATENT AND TRADEMARK OFFICE

CERTIFICATE OF CORRECTION

PATENT NO. : 7,984,567 B2
APPLICATION NO. : 12/246642
DATED : July 26, 2011
INVENTOR(S) : Christ Bill Bertakis It is certified that error appears in the above-identified patent and that said Letters Patent is hereby corrected as shown below:

Column 4, Line 27, before "face" insert -- a --.

Column 4, Line 30, before "face" insert -- a --.

Signed and Sealed this
Thirteenth Day of September, 2011

David J. Kappos

David J. Kappos
*Director of the United States Patent and Trademark Office*